United States Patent [19]

Holladay

[11] Patent Number: 4,852,756

[45] Date of Patent: Aug. 1, 1989

[54] SHIPPING CONTAINER

[75] Inventor: John T. Holladay, Pinson, Tenn.

[73] Assignee: Packaging Corporation of America, Evanston, Ill.

[21] Appl. No.: 152,433

[22] Filed: Feb. 5, 1988

[51] Int. Cl.[4] ..... B65D 19/20

[52] U.S. Cl. ..... 220/4 F; 206/386; 229/23 C; 229/DIG. 2

[58] Field of Search ..... 229/23 C, 23 R, DIG. 2; 206/386, 335; 220/4 F, 1.5

[56] References Cited

U.S. PATENT DOCUMENTS

| | | | |
|---|---|---|---|
| 520,366 | 5/1894 | Leaver | 229/DIG. 2 |
| 1,665,033 | 4/1928 | Jensen | 220/443 |
| 2,730,287 | 1/1956 | Mueller | 229/23 C |
| 2,762,502 | 9/1956 | Lehman | 206/335 |
| 2,815,163 | 12/1957 | King | 206/386 |
| 3,021,044 | 2/1962 | Schubert | 206/386 |
| 3,495,756 | 2/1970 | Achermann et al. | 206/386 |
| 3,756,498 | 9/1973 | Anderson | 229/23 C |
| 4,087,041 | 5/1978 | Centanni | 220/443 |
| 4,171,741 | 10/1979 | Fish | 229/23 C |
| 4,390,154 | 6/1983 | Ostler et al. | 229/DIG. 2 |
| 4,441,649 | 4/1984 | Nederveld | 206/386 |
| 4,623,072 | 11/1986 | Lorenz | 229/DIG. 2 |
| 4,746,059 | 5/1988 | Jackson | 220/4 F |
| 4,762,226 | 8/1988 | Gatton | 206/386 |
| 4,804,087 | 2/1989 | Smith | 206/335 |

*Primary Examiner*—Harvey C. Hornsby
*Assistant Examiner*—Corinne M. Reinckens
*Attorney, Agent, or Firm*—Neuman, Williams, Anderson & Olson

[57] ABSTRACT

A shipping container is provided for accommodating a heavy, bulky article, such as riding lawn mowers or the like. The container includes a skid section, which subtends and supportingly engages the accommodated article; a tubular section of corrugated fibreboard which is secured to and extends upwardly from the skid section and embraces the accommodated article; and a cover section of corrugated fibreboard, which overlies the accommodated article and is secured to an upper portion of the tubular section. No corner posts or inner packing are required in order to enhance the stacking strength of the improved container.

6 Claims, 2 Drawing Sheets

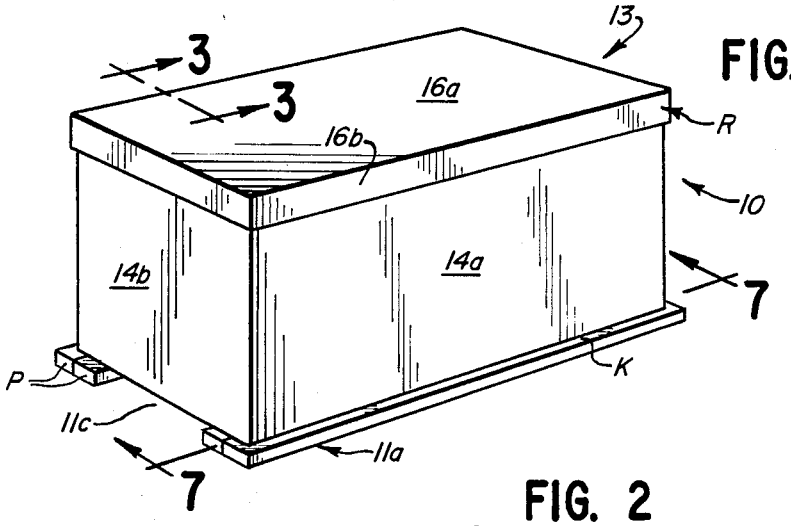
FIG. 1
FIG. 2
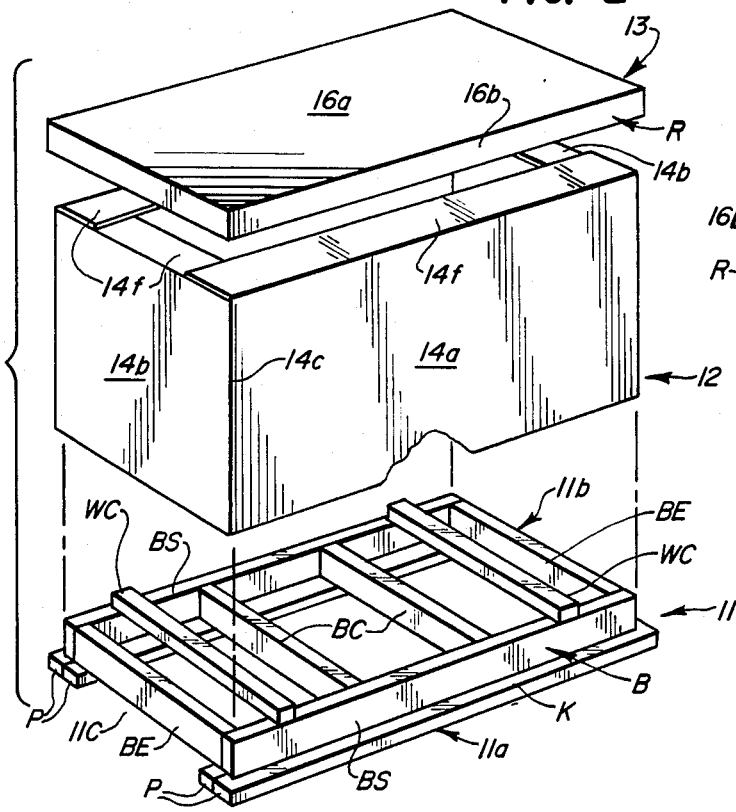
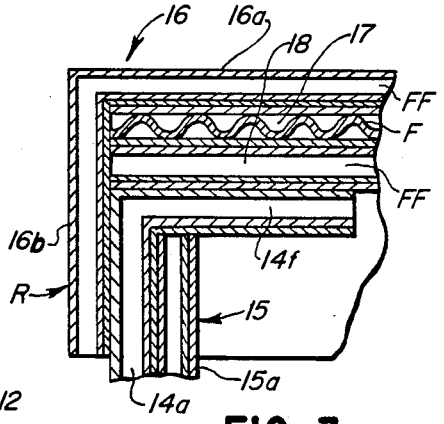
FIG. 3
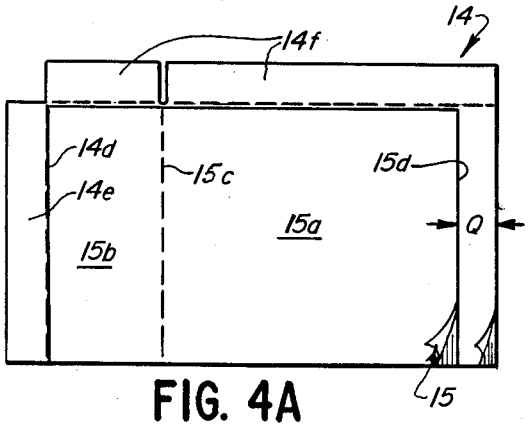
FIG. 4A
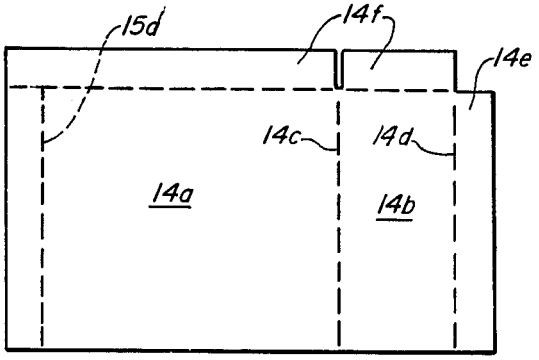
FIG. 4B FIG. 5
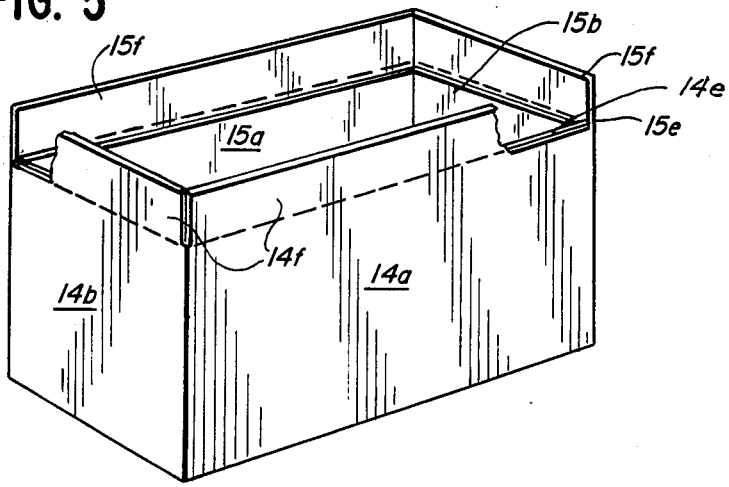
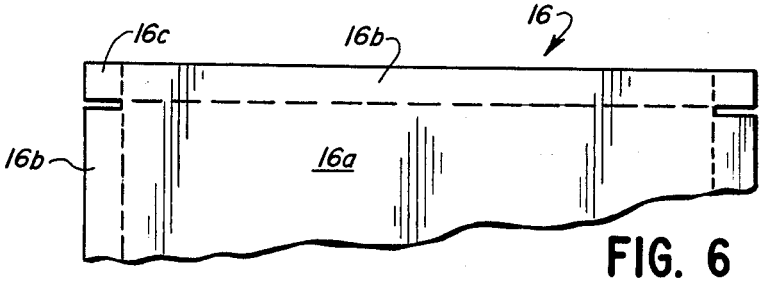
FIG. 6
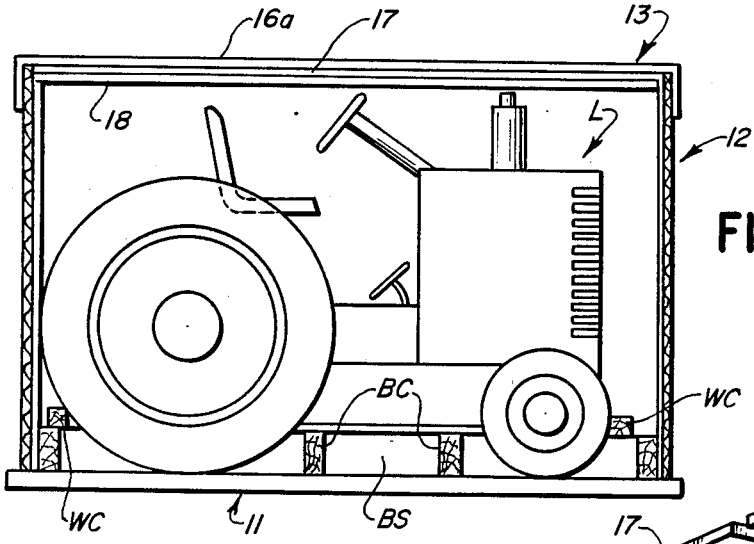
FIG. 7
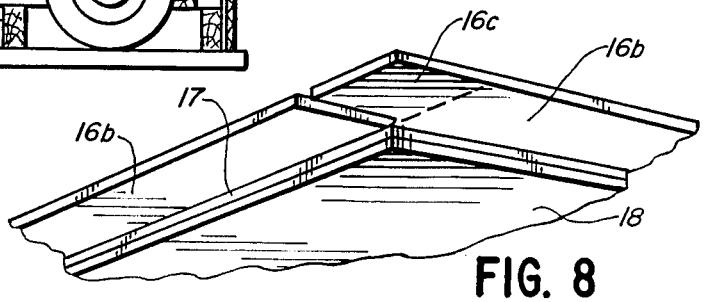
FIG. 8

SHIPPING CONTAINER

BACKGROUND OF THE INVENTION

The packing or crating of heavy, bulky articles, such as riding lawn mowers and the like, for storage and/or shipping has always been a difficult, time-consuming, costly and labor intensive operation. To provide the necessary stacking strength and protection for such articles, it has been and is customary to utilize a plurality of upwardly extending posts, normally of wood or similar material, and suitable inner packing or bracing members. Often in the past the operation involved custom building of the container or crate for each accommodated article; thus, requiring numerous components and skilled labor to assemble the components into the desired structure. Once the crated article was received by the customer or retailer, it was an awkward, difficult operation to uncrate the article, requiring a variety of tools and one possessed of considerable physical strength and dexterity.

SUMMARY OF THE INVENTION

Thus, it is an object of the invention to provide a shipping container of the type described which avoids the aforenoted shortcomings besetting prior structures.

It is a further object to provide an improved shipping container which utilizes a minimum number of components and may be readily set up with a minimum amount of manual labor.

It is a further object to provide an improved shipping container which does not require vertically disposed supporting posts and inner packing or bracing members to attain the necessary stacking strength.

It is a still further object to provide an improved container wherein the various components thereof are of simple, inexpensive construction and may be readily assembled in a facile, expeditious manner.

Further and additional objects will appear from the description, accompanying drawings and appended claims.

In accordance with one embodiment of the invention, an improved shipping container is provided for accommodating a bulky, heavy article, such as a riding lawn mower or the like. The container includes a skid section which is adapted to subtend and supportingly engage the accommodated article. Secured to and extending upwardly from the skid section is a tubular section formed of corrugated fibreboard. The tubular section is adapted to embrace the accommodated article. Secured to an upper portion of the tubular section and overlying the accommodated article is a cover section which is formed of corrugated fibreboard. The cover section includes a center panel having a plurality of corrugated fibreboard laminas affixed in substantially superposed relation to an interior surface of the center panel. The center panel is delineated by a depending flange. The skid section includes a base segment defining a substantially horizontal plane and a frame segment mounted thereon and extending upwardly therefrom. The frame segment is provided with a plurality of peripheral leg members to which the lower portion of the tubular section is attached. Predetermined leg members are recessed from the periphery of the base segment whereby the latter is provided with a marginal ledge against which the lower portion of the tubular section may rest.

DESCRIPTION OF THE INVENTION

For a more complete understanding of the invention reference is made to the drawings wherein:

FIG. 1 is a perspective top view of a preferred embodiment of the improved shipping container showing the various components thereof in a fully assembled relation.

FIG. 2 is similar to FIG. 1 but showing the basic components of the container in exploded relation.

FIG. 3 is an enlarged fragmentary sectional view taken along line 3—3 of FIG. 1.

FIGS. 4A and 4B are top and bottom plan views of complemental blanks of corrugated fibreboard which coact with one another to form the tubular section.

FIG. 5 is a fragmentary, perspective top view of the blanks of FIGS. 4A and 4B folded relative to one another and secured together to form a tubular section.

FIG. 6 is an enlarged, fragmentary, top plan view of a blank of corrugated fibreboard from which the cover section is formed.

FIG. 7 is a sectional view taken along line 7—7 of FIG. 1 and showing a riding lawn mower accommodated within the container.

FIG. 8 is an enlarged, fragmentary, perspective view of the interior surface of the cover section blank of FIG. 6 and showing a plurality of corrugated fibreboard laminas affixed to the interior surface of a center panel of the blank.

Referring now to the drawings and more particularly to FIGS. 1, 2 and 7, an improved shipping container 10 is shown for use in accommodating a bulky, heavy article L, such as a riding lawn mower or the like, see FIG. 7. As seen in FIG. 2 the container 10 comprises three basic components; namely, a skid section 11, a tubular section 12 and a cover section 13.

The skid section 11 is preferably formed of a plurality of wooden planks P (e.g. 2″×6″) arranged in parallel relation so as to form a base segment 11*a* defining a substantially horizontal plane, and a plurality of elongated wooden members B (e.g. 3×4) interconnected so as to form a skeletal rectangular frame segment 11*b*. The planks P of the base segment are relatively disposed so as to form at least one end opening 11*c* which is adapted to slidably receive the tines of a fork-lift truck, not shown. As seen in FIG. 2, frame segment 11*b* includes a pair of relatively spaced substantially parallel side or leg members BS, a pair of elongated relatively spaced substantially parallel end members BE interconnecting corresponding ends of the side members BS, and a plurality of relatively spaced substantially parallel cross members BC which are disposed between the end members. It is preferred that the spacings between the side members BS and between the end members BE and the adjacent cross members BC be such that the wheels of the accommodated article will fit therebetween, see FIG. 7. In order to stabilize the accommodated article, optional wheel chocks WC in the form of cross beams are provided which are fastened to the upper surfaces of the side members BS. The ends of the beams WC terminate at the exterior side surfaces of the side members BS. The wheel chocks snugly engage the front and back wheels of the accommodated mower, as seen in FIG. 7. The number, size and location of the chocks may vary and will depend upon the type and style of the article accommodated in the container.

The end members BE and the cross members BC maintain the side members in proper spaced relation and are engaged by the tines of the forklift truck when such tines are disposed within the base segment opening 11c. In instances where the tines are to extend widthwise rather than lengthwise, of the container 10, the planks forming the base segment may extend at right angles to the side members BS and be arranged so as to provide at least one opening, not shown, along the side of the skid section rather than at the end, as shown.

The tubular section 12 may be formed from a single blank, not shown, of laminated double wall corrugated fibreboard material or a pair of complemental blanks 14 of like material and configuration, see FIGS. 4A and 4B, respectively. Each blank 14 includes a rectangular side panel **14*a*, and an end panel 14*b* connected by a foldline 14*c*, to one narrow side edge of panel 14*a*. Connected by a foldline 14*d*, to a side edge of end panel 14*b*, which is opposite foldline 14*c*, is a joint flap 14*e***.

Laminated to the interior surface of the side and end panels **14*a* and 14*b* of each blank is a supplemental panel 15 of single wall corrugated fiberboard. Panel 15 includes a first section 15*a*, which overlies the interior surface of panel 14*a*, and a second section 15*b* which is connected by foldline 15*c* to one side of section 15*a*. The second section 15*b* overlies the interior surface of the end panel 14*b*. One edge 15*d* of section 15*a* is set back from a corresponding edge of panel 14*a* by a sufficient amount Q so as to not interfere with the joint flap 14*e* adhering to the interior surface of panel 14*a*** of the other blank when the tubular section is being formed, as will be described hereinafter.

When forming the tubular section, the end panel **14*b* of each blank is folded about foldline 14*c* inwardly so that the end panel is disposed at a right angle relative to the laminated interior surface of the respective side panel. The joint flap 14*e* is also folded about foldline 14*d* so that it is at a right angle to the laminated interior surface of the end panel. The blanks 14, when folded in the manner as afore-described, are placed in the relative positions as shown in FIG. 5; that is to say, the side panels 14*a* are in spaced parallel relation, the joint flaps 14*e* are adjacent portions Q of the interior surfaces of side panels 14*a* and the end panels 14*b* are in spaced parallel relation. The joint flaps are then secured by adhesive, stitching or stapling to the adjacent side panel portions Q. If desired, the joint flaps 14*e* may be foldably connected to the opposite edges of the side panels and be secured to the interior surfaces of the adjacent end panels when the blanks 14 are joined together to form the tubular section. In the latter situation, an edge of section 15*b* of supplemental panel 15 is setback a sufficient amount so as not to interfere with the adhesion between the flap and interior surface of the end panel. The section 15*a* of panel 15 in such a construction will be substantially coincident to the side panel 14*a*. In either arrangement, it is important the flutes of the side and end panels 14*a*, 14*b* and the first and second sections 15*a*, 15*b* extend vertically when the tubular section 12** is in place.

As illustrated, the upper portion and/or the bottom portion of the tubular section 12 may be provided with closure flaps **14*f* which are adapted to be folded so as to extend into the area defined by the side and end panels. Where closure flaps are connected to only the upper portions of the side and end panels, the lower portions of the tubular section 12 will embrace the accommodated lawn mower and have the lower portions of the side panels 14*a* and the end panels 14*b*** affixed by suitable fasteners or adhesive to the side and end members BS and BE of the frame segment.

When enclosing the mower within tubular section 12, the mower L is first spotted and chocked with respect to the frame segment and then the set up tubular section is manually slipped down over the top of the accommodated article (e.g. mower). The area defined by the side and end panels of the tubular section is of such size and shape that the accommodated mower and the frame segment will not obstruct the positioning of the tubular section 12 relative to the skid section 11.

As seen in FIGS. 1 and 2 the skid section 11 is provided with a peripheral ledge K which is formed by the frame segment members BS and BE being recessed from the periphery of the base segment **11*a*. The ledge K may be only wide enough to accommodate the lower portions of the side and end panels 14*a*, 14*b*** of the tubular section. The ledge also provides a clearance between adjacent tubular sections when the containers are positioned in abutting side by side or end to end relation.

Where, however, the tubular section is provided with bottom closure flaps, not shown, the setup tubular section may be first mounted on the skid section so that the folded bottom closure flaps are folded back against the interior surfaces of the side and end panels **14*a* and 14*b*; thereby being wedged between the side and end panels of the tubular section and the respective side and end members BS and BE of the frame segment. The mower is then loaded into the tubular section 12 through the open upper portion. Once the mower is in place within the tubular section, the top closure flaps 14*f* are manually folded so as to assume the position shown in FIG. 2 and the cover section 13** affixed in a closed position.

The cover section 13 is preferably formed from a blank 16 of single wall corrugated fibreboard, see FIGS. 6 and 8. The blank includes a center panel **16*a* having a shape substantially corresponding to the area defined by the exterior of the side and end panels of the tubular section 12. Foldably connected to the periphery of the center panel 16*a* are marginal panels 16*b* which are adapted to be folded relative to the center panel so as to form a depending rim or flange R, see FIGS. 1 and 2. Adjacent marginal panels 16*b* are interconnected by a conventional foldable joint flap 16*c* provided on an end edge of one of the adjoining panels 16*b*** defining a corner of the cover section. The joint flaps engage and are secured by adhesive, stitching, banding or stapling to the interior surface of the other panels defining the corners.

As seen in FIG. 8, the interior surface of the center panel **16*a* of the cover section 13 is reinforced by a pair of laminas 17, 18 of double wall corrugated fibreboard which are secured in superposed relation to one another and to the center panel 16*a*. The peripheries of the laminas are concealed by the folded marginal panels 16*b*. When the cover section 13 is properly assembled on the upper portion of the tubular section 12, the top closure flaps 14*f* will engage the exposed surface of lamina 18. It is important from a structural strength standpoint, that the flute direction F in lamina 17 be substantially transverse to the flute directions FF of both center panel 16*a* and lamina 18, see FIG. 3. Once the cover section 13 is properly assembled on the upper portion of the tubular section 12, the marginal panels 16*b* of the cover section 13** may be secured to the upper portion of the tubular section.

It has been found with the improved container that where the accommodated article weighs between 450–500 lbs.; the tubular section 12 and panels 15 therefor, and the cover blank and cover section laminas 17, 18 are formed of 500 lb. double wall corrugated fibreboard; and the tubular section 12 has a height of 34–43½", a length of 65–70" and a width of 40–45", such containers may be safely stacked six high for storage and/or shipment.

As previously mentioned no corner posts, inner packing or bracing members are required in order to provide the desired stacking strength when the loaded improved containers are stacked six high. Furthermore, the improved container comprises a minimum number of components thereby reducing significantly the need to inventory a large variety of components. Because of the minimum number of components, assembly thereof to form the container is facilitated and expedited and the amount of labor required is significantly reduced.

While the improved container is illustrated as having a rectangular configuration, the invention as herein disclosed and claimed is not intended to be limited thereto.

I claim:

1. A shipping container void of upright supports and inner packing, for accommodating a heavy, bulky article, said container comprising a skid section for subtending and supportingly engaging the accommodated article; a tubular section for embracing the accommodated article and being secured to and extending upright from said skid section; and a cover section for overlying the accommodated article and having a depending marginal flange encompassing and being secured to an upper end portion of said tubular section; said tubular section being formed of a pair of interconnected complemental blanks of corrugated fiberboard material, each blank including an outer lamina of corrugated fiberboard material, and an inner lamina of corrugated fiberboard material secured to a concealed surface of said outer lamina, said outer and inner laminas, each having opposed upright side edge portions, the side edge portions of said outer lamina of each blank extending a like amount beyond the corresponding side edge portions of said inner lamina and forming a joint flap and a side panel portion, each spanning substantially the distance between the skid and cover sections, the joint flap of each blank outer lamina being affixed to and concealed by the side panel portion of the outer lamina of the other blank whereby the joint flap abuts a side edge of the second lamina of said other blank; said cover section including a center portion delimited by said depending marginal flange, said center portion having an outer lamina and an inner lamina, the latter having a peripheral configuration substantially corresponding to an area defined by the exterior surface of the upper end portion of said tubular section; the laminas of said tubular section blanks having flutes extending in an upright direction.

2. The shipping container of claim 1 wherein the tubular section defines a multi-sided area in which the accommodated article is disposed; said cover section including a center panel having a configuration conforming substantially to the multi-sided area defined by said tubular section.

3. The shipping container of claim 1 wherein said skid section includes a base segment defining a substantially horizontal plane, and a frame segment mounted on and projecting upwardly from said base segment; said frame segment including elongated members mounted on said base segment and arranged relative to one another so as to form an area corresponding substantially to the area defined by said tubular section when the latter is embracing the accommodated article; a predetermined number of said members being recessed from the periphery of said base segment whereby said skid section is provided with a marginal ledge; said tubular section having a lower edge portion resting on said ledge and secure to the recessed members of said skid section.

4. The shipping container of claim 1 wherein the upper portion of the tubular section is provided with foldable closure flaps which subtend the center portion of said cover section and at least partially overlie the accommodated article.

5. The shipping container of claim 1 wherein the inner and outer laminas of the center portion of the cover section are formed of corrugated fiberboard material; the corrugated fiberboard of the outer lamina having elongated flutes angularly disposed relative to elongated flutes provided in the corrugated fiberboard of said inner lamina.

6. The shipping container of claim 5 wherein the center panel outer lamina is formed of single wall corrugated fibreboard, and the intermediate and inner laminas are formed of at least double-walled corrugated fibreboard.

* * * * *